US011067080B2

(12) United States Patent
Mesward et al.

(10) Patent No.: US 11,067,080 B2
(45) Date of Patent: Jul. 20, 2021

(54) LOW COST SCROLL COMPRESSOR OR VACUUM PUMP

(71) Applicant: Air Squared, Inc., Broomfield, CO (US)

(72) Inventors: Joshua R. Mesward, Arvada, CO (US); Scott D. Farnham, Westminster, CO (US)

(73) Assignee: Air Squared, Inc., Broomfield, CO (US)

( * ) Notice: Subject to any disclaimer, the term of this patent is extended or adjusted under 35 U.S.C. 154(b) by 134 days.

(21) Appl. No.: 16/275,943

(22) Filed: Feb. 14, 2019

(65) Prior Publication Data

US 2020/0025201 A1 Jan. 23, 2020

Related U.S. Application Data

(60) Provisional application No. 62/699,529, filed on Jul. 17, 2018, provisional application No. 62/714,481, filed on Aug. 3, 2018.

(51) Int. Cl.
*F01C 1/02* (2006.01)
*F04C 18/02* (2006.01)
(Continued)

(52) U.S. Cl.
CPC ..... *F04C 18/0284* (2013.01); *F01C 1/0215* (2013.01); *F01C 1/0284* (2013.01);
(Continued)

(58) Field of Classification Search
CPC ..... F04C 18/0284; F04C 18/0215; F04C 27/005; F04C 29/04; F04C 18/086;
(Continued)

(56) References Cited

U.S. PATENT DOCUMENTS 801,182 A 10/1905 Creux
2,079,118 A 5/1937 Hingst
(Continued)

FOREIGN PATENT DOCUMENTS

CN 104235018 12/2014
CN 104632636 5/2015
(Continued)

OTHER PUBLICATIONS

"Heat Pump and Refrigeration Cycle," Wikipedia, last updated May 10, 2013, 4 pages [retrieved online from: en.wikipedia.org/wiki/Heat_pump_and_refrigeration_cycle].
(Continued)

*Primary Examiner* — Deming Wan
(74) *Attorney, Agent, or Firm* — Sheridan Ross P.C.

(57) ABSTRACT

A low cost scroll device and methods of manufacturing the same are described. The scroll device includes, for example, a drive pin hole and bearing bores machined into a scroll of the scroll device from the same side as the involute of the scroll; idler shaft assemblies with no more than one bearing in the orbiting scroll for mechanically coupling the orbiting scroll to the fixed scroll; and an epoxy coating applied using a process that requires assembly of the scroll device only once.

18 Claims, 7 Drawing Sheets

(51) Int. Cl.

| | |
|---|---|
| ***F04C 27/00*** | (2006.01) |
| ***F01C 19/00*** | (2006.01) |
| ***F04C 29/04*** | (2006.01) |
| ***F01C 17/06*** | (2006.01) |

(52) U.S. Cl.
CPC ..... *F01C 17/06* (2013.01); *F04C 18/0215* (2013.01); *F04C 27/005* (2013.01); *F04C 29/04* (2013.01)

(58) Field of Classification Search
CPC ..... F04C 2/086; F01C 1/0215; F01C 19/08; F01C 19/005
See application file for complete search history.

(56) References Cited

U.S. PATENT DOCUMENTS 2,330,121 A 9/1943 Heintz
2,968,157 A 1/1961 Cronan
3,011,694 A 12/1961 Mulhouse et al.
3,262,573 A 7/1966 Schutte
3,470,704 A 10/1969 Kantor
3,613,368 A 10/1971 Doerner
3,802,809 A 4/1974 Vulliez
3,842,596 A 10/1974 Gray
3,874,827 A 4/1975 Young
3,884,599 A 5/1975 Young et al.
3,924,977 A 12/1975 McCullough
3,986,799 A 10/1976 McCullough
3,986,852 A 10/1976 Doerner et al.
3,994,633 A 11/1976 Shaffer
3,994,635 A 11/1976 McCullough
3,994,636 A 11/1976 McCullough et al.
3,999,400 A 12/1976 Gray
4,065,279 A 12/1977 McCullough
4,069,673 A 1/1978 Lapeyre
4,082,484 A 4/1978 McCullough
4,121,438 A 10/1978 McCullough
4,129,405 A 12/1978 McCullough
4,157,234 A 6/1979 Weaver et al.
4,160,629 A 7/1979 Hidden et al.
4,192,152 A 3/1980 Armstrong et al.
4,199,308 A 4/1980 McCullough
4,216,661 A 8/1980 Tojo et al.
4,259,043 A 3/1981 Hidden et al.
4,300,875 A 11/1981 Fischer et al.
4,340,339 A 7/1982 Hiraga et al.
4,382,754 A 5/1983 Shaffer et al.
4,395,205 A 7/1983 McCullough
4,395,885 A 8/1983 Cozby
4,403,494 A 9/1983 McCullough
4,411,605 A 10/1983 Sauls
4,415,317 A 11/1983 Buttersworth
4,416,597 A 11/1983 Eber et al.
4,424,010 A 1/1984 McCullough
4,436,495 A 3/1984 McCullough
4,457,674 A 7/1984 Kawano et al.
4,462,771 A 7/1984 Teegarden
4,463,591 A 8/1984 McCullough
4,472,120 A 9/1984 McCullough
4,475,346 A 10/1984 Young et al.
4,477,238 A 10/1984 Terauchi
4,511,091 A 4/1985 Vasco
4,512,066 A 4/1985 McCullough
4,673,339 A 6/1987 Hayano et al.
4,718,836 A 1/1988 Pottier et al.
4,722,676 A 2/1988 Sugimoto
4,726,100 A 2/1988 Etemad et al.
4,730,375 A 3/1988 Nakamura et al.
4,732,550 A 3/1988 Suzuki et al.
4,802,831 A 2/1989 Suefuji et al.
4,867,657 A 9/1989 Kotlarek et al.
4,875,839 A 10/1989 Sakata et al.
4,892,469 A 1/1990 McCullough et al.
4,911,621 A 3/1990 McCullough et al.
4,918,930 A 4/1990 Gaudet et al.
4,927,340 A 5/1990 McCullough
5,013,226 A 5/1991 Nishida
5,037,280 A 8/1991 Nishida et al.
5,040,956 A 8/1991 Barito et al.
5,044,904 A 9/1991 Richardson, Jr.
5,051,075 A 9/1991 Young
5,051,079 A 9/1991 Richardson, Jr.
5,082,430 A 1/1992 Guttinger
5,099,658 A 3/1992 Utter et al.
5,108,274 A 4/1992 Kakuda et al.
5,127,809 A 7/1992 Amata et al.
5,142,885 A 9/1992 Utter et al.
5,149,255 A 9/1992 Young
5,157,928 A 10/1992 Gaudet et al.
5,160,253 A 11/1992 Okada et al.
5,176,004 A 1/1993 Gaudet
5,214,932 A 6/1993 Abdelmalek
5,222,882 A 6/1993 McCullough
5,224,849 A 7/1993 Forni
5,228,309 A 7/1993 McCullough
5,232,355 A 8/1993 Fujii et al.
5,242,284 A 9/1993 Mitsunaga et al.
5,247,795 A 9/1993 McCullough
RE34,413 E 10/1993 McCullough
5,256,042 A 10/1993 McCullough et al.
5,258,046 A 11/1993 Naga et al.
5,265,431 A 11/1993 Gaudet et al.
5,286,179 A 2/1994 Forni et al.
5,314,316 A 5/1994 Shibamoto et al.
5,328,341 A 7/1994 Forni
5,338,159 A 8/1994 Riffe et al.
5,343,708 A 9/1994 Gaudet et al.
5,354,184 A 10/1994 Forni
5,417,554 A 5/1995 Kietzman et al.
5,443,368 A 8/1995 Weeks et al.
5,449,279 A 9/1995 Hill et al.
5,450,316 A 9/1995 Gaudet et al.
5,462,419 A 10/1995 Hill et al.
5,466,134 A 11/1995 Shaffer et al.
5,496,161 A 3/1996 Machida et al.
5,609,478 A 3/1997 Utter et al.
5,616,015 A 4/1997 Liepert
5,616,016 A 4/1997 Hill et al.
5,632,612 A 5/1997 Shaffer
5,632,613 A 5/1997 Shin et al.
5,637,942 A 6/1997 Forni
5,720,602 A 2/1998 Hill et al.
5,746,719 A 5/1998 Ferra et al.
5,752,816 A 5/1998 Shaffer
5,759,020 A 6/1998 Shaffer
5,800,140 A 9/1998 Forni
5,803,723 A 9/1998 Suefuji et al.
5,836,752 A 11/1998 Calhoun et al.
5,842,843 A 12/1998 Haga
5,855,473 A 1/1999 Liepert
5,857,844 A 1/1999 Lifson et al.
5,873,711 A 2/1999 Lifson
5,938,419 A 8/1999 Honma et al.
5,951,268 A 9/1999 Pottier et al.
5,961,297 A * 10/1999 Haga ..... F04C 18/0215 417/252
5,987,894 A 11/1999 Claudet
6,008,557 A 12/1999 Dornhoefer et al.
6,022,195 A 2/2000 Gaudet et al.
6,050,792 A 4/2000 Shaffer
6,068,459 A 5/2000 Clarke et al.
6,074,185 A 6/2000 Protos
6,098,048 A 8/2000 Dashefsky et al.
6,129,530 A 10/2000 Shaffer
6,179,590 B1 1/2001 Honma et al.
6,186,755 B1 2/2001 Haga
6,190,145 B1 2/2001 Fujioka et al.
6,193,487 B1 2/2001 Ni
6,213,970 B1 4/2001 Nelson et al.
6,283,737 B1 9/2001 Kazikis et al.
6,318,093 B2 11/2001 Gaudet et al.
6,379,134 B2 4/2002 Iizuka
6,434,943 B1 8/2002 Garris

(56) References Cited

U.S. PATENT DOCUMENTS 6,439,864 B1 8/2002 Shaffer
6,460,351 B2 10/2002 Gaudet et al.
6,461,113 B1 10/2002 Gaudet et al.
6,464,467 B2 10/2002 Sullivan et al.
6,511,308 B2 1/2003 Shaffer
6,623,445 B1 9/2003 Nelson et al.
6,644,946 B2 11/2003 Nakane et al.
6,663,364 B2 12/2003 Okada et al.
6,712,589 B2 3/2004 Mori et al.
6,736,622 B1 5/2004 Bush et al.
6,755,028 B2 6/2004 Gaudet et al.
6,902,378 B2 6/2005 Gaudet et al.
6,905,320 B2 6/2005 Satoh et al.
6,922,999 B2 8/2005 Kimura et al.
7,111,467 B2 9/2006 Apparao et al.
7,124,585 B2 10/2006 Kim et al.
7,144,383 B2 12/2006 Arnett et al.
7,181,928 B2 2/2007 de Larminat
7,234,310 B2 6/2007 Flynn et al.
7,249,459 B2 7/2007 Hisanaga et al.
7,297,133 B2 11/2007 Nelson et al.
7,306,439 B2 12/2007 Unami et al.
7,314,358 B2 1/2008 Tsuchiya
7,439,702 B2 10/2008 Smith et al.
7,458,152 B2 12/2008 Sato
7,458,414 B2 12/2008 Simon
7,836,696 B2 11/2010 Uno et al.
7,861,541 B2 1/2011 Dieckmann et al.
7,906,016 B2 3/2011 Weber et al.
7,942,655 B2 5/2011 Shaffer
7,980,078 B2 7/2011 McCutchen et al.
8,007,260 B2 8/2011 Yanagisawa
8,087,260 B2 1/2012 Ogata et al.
8,186,980 B2 5/2012 Komai et al.
8,328,544 B2 12/2012 Iwano et al.
8,484,974 B1 7/2013 Monson et al.
8,523,544 B2 9/2013 Shaffer
8,668,479 B2 3/2014 Shaffer
8,674,525 B2 3/2014 Van Den Bossche et al.
8,858,203 B2 10/2014 Kanizumi et al.
9,022,758 B2 5/2015 Roof et al.
9,028,230 B2 5/2015 Shaffer
9,074,598 B2 7/2015 Shaffer et al.
9,657,733 B2 5/2017 Chadwick et al.
9,784,139 B2 10/2017 Shaffer et al.
9,885,358 B2 2/2018 Shaffer
10,221,852 B2 3/2019 Shaffer et al.
2001/0012485 A1 8/2001 Gaudet et al.
2001/0038800 A1* 11/2001 Kimura ..... F04C 18/0215 418/55.2
2001/0043878 A1 11/2001 Sullivan et al.
2002/0011332 A1 1/2002 Oh et al.
2002/0039534 A1 4/2002 Moroi et al.
2002/0071779 A1 6/2002 Moroi et al.
2002/0094277 A1 7/2002 Gaudet et al.
2002/0104320 A1 8/2002 Gaudet et al.
2003/0017070 A1 1/2003 Moroi et al.
2003/0051487 A1 3/2003 Gaudet et al.
2003/0138339 A1 7/2003 Scancarello
2003/0223898 A1 12/2003 Fujioka et al.
2004/0020206 A1 2/2004 Sullivan et al.
2004/0184940 A1 9/2004 Nakane et al.
2004/0194477 A1 10/2004 Gaudet et al.
2004/0241030 A1* 12/2004 Matsushima ..... F04C 29/04 418/60
2004/0255591 A1 12/2004 Hisanga et al.
2005/0025651 A1* 2/2005 Sowa ..... F04C 29/0021 418/55.1
2005/0031469 A1 2/2005 Yanagisawa et al.
2005/0081536 A1 4/2005 Gaudet et al.
2005/0196284 A1 9/2005 Gaudet et al.
2005/0220649 A1 10/2005 Sato
2006/0016184 A1 1/2006 Simon
2006/0045783 A1 3/2006 Yanagisawa et al.
2006/0130495 A1 6/2006 Dieckmann et al.
2007/0071626 A1* 3/2007 Tsuchiya ..... F04C 27/005 418/55.4
2007/0104602 A1 5/2007 Ishikawa et al.
2007/0108934 A1 5/2007 Smith et al.
2007/0172373 A1 7/2007 Ni
2007/0231174 A1 10/2007 Ishizuki
2008/0159888 A1 7/2008 Nakayama et al.
2008/0193311 A1 8/2008 Helies
2008/0206083 A1* 8/2008 Suefuji ..... F01C 19/08 418/55.4
2009/0148327 A1 6/2009 Carter et al.
2009/0246055 A1 10/2009 Stehouwer et al.
2010/0044320 A1 2/2010 Weber et al.
2010/0111740 A1 5/2010 Ni
2010/0254835 A1 10/2010 Kane et al.
2010/0287954 A1 11/2010 Harman et al.
2011/0129362 A1 6/2011 Kameya et al.
2011/0176948 A1* 7/2011 Shaffer ..... F04C 29/04 418/55.6
2011/0256007 A1* 10/2011 Shaffer ..... F04C 29/005 418/5
2012/0134862 A1 5/2012 Hockliffe et al.
2013/0149179 A1* 6/2013 Sato ..... F01C 1/0215 418/55.3
2013/0207396 A1 8/2013 Tsuboi
2013/0232975 A1 9/2013 Shaffer et al.
2014/0023540 A1 1/2014 Heidecker et al.
2014/0260364 A1 9/2014 Litch
2017/0045046 A1 2/2017 Afshari
2017/0051741 A1 2/2017 Shaffer et al.
2017/0067469 A1* 3/2017 Malvasi ..... F04D 29/0473
2017/0074265 A1 3/2017 Asami et al.
2017/0268514 A1 9/2017 Shaffer
2017/0284284 A1 10/2017 Takamiya
2017/0306956 A1 10/2017 Monet
2017/0321699 A1 11/2017 Kawano et al.
2017/0362962 A1 12/2017 Shaffer et al.
2018/0163725 A1 6/2018 Valdez et al.
2018/0163726 A1 6/2018 Shaffer et al.
2018/0216498 A1 8/2018 Shaffer et al.
2019/0211824 A1 7/2019 Shaffer et al.
2020/0040892 A1 2/2020 Dieckmann et al.

FOREIGN PATENT DOCUMENTS

CN 105402134 3/2016
DE 460936 6/1928
DE 19957425 8/2000
EP 0513824 11/1992
EP 0780576 6/1997
EP 1464838 10/2004
EP 3239526 11/2017
GB 0513827 10/1939
GB 2002455 2/1979
GB 1575684 9/1980
JP S56-019369 2/1981
JP S57-171002 10/1982
JP H05-157076 6/1993
JP H07-109981 4/1995
JP H07-324688 12/1995
JP H08-261182 10/1996
JP 2000-213475 8/2000
JP 2011-012629 1/2011
WO WO 2004/008829 1/2004
WO WO 2009/050126 4/2009
WO WO 2015/164453 10/2015
WO WO 2017/089745 6/2017

OTHER PUBLICATIONS

"Involute," Wikipedia, last modified Jun. 2, 2012, 5 pages [retrieved online from: en.wikipedia.org/wiki/Involute].
"Oldham Coupler," Wikipedia, last modified, Feb. 9, 2010, 2 pages [retrieved online from: en.wikipedia.org/wiki/Oldham_coupler].
"Organic Rankine Cycle," Wikipedia, last modified May 19, 2013, 4 pages [retrieved online from: en.wikipedia.org/wiki/Organic_Rankine_Cycle].

(56) References Cited

OTHER PUBLICATIONS

"Rankine Cycle," Wikipedia, last modified Apr. 29, 2013, 4 pages [retrieved online from: en.wikipedia.org/wiki/Rankine_cycle].
"Scroll Compressor," Wikipedia, last modified Apr. 24, 2013, 3 pages [retrieved online from: en.wikipedia.org/wiki/Scroll_compressor].
"Thrust Bearing," Wikipedia, last modified Dec. 19, 2012, 2 pages [retrieved online from: en.wikipedia.org/wiki/Thrust_bearing].
International Search Report and Written Opinion for International (PCT) Patent Application No. PCT/US2018/064427, dated Feb. 5, 2019 14 pages.
International Search Report for International (PCT) Patent Application No. PCT/US01/43523, dated Jun. 5, 2002 1 page.
International Search Report for International (PCT) Patent Application No. PCT/US01/50377, dated May 13, 2002 1 page.
Partial Search Report for European Patent Application No. 13003663.5, dated May 28, 2014 5 pages.
Extended Search Report for European Patent Application No. 13003663.5, dated Sep. 3, 2014 11 pages.
International Search Report and Written Opinion for International (PCT) Patent Application No. PCT/US14/00076, dated Dec. 17, 2014 6 pages.
International Search Report and Written Opinion for International (PCT) Patent Application No. PCT/US18/00118, dated Sep. 24, 2018 19 pages.
Official Action for U.S. Appl. No. 11/703,585, dated Dec. 18, 2009 7 pages.
Official Action for U.S. Appl. No. 11/703,585, dated Jul. 20, 2010 7 pages.
Notice of Allowance for U.S. Appl. No. 11/703,585, dated Feb. 4, 2011 4 pages.
Official Action for U.S. Appl. No. 12/930,140, dated Jan. 14, 2013 22 pages.
Official Action for U.S. Appl. No. 12/930,140, dated Jun. 13, 2013 21 pages.
Notice of Allowance for U.S. Appl. No. 12/930,140, dated Oct. 24, 2013 12 pages.
Official Action for U.S. Appl. No. 13/066,261, dated Feb. 11, 2013 5 pages Restriction Requirement.
Notice of Allowance for U.S. Appl. No. 13/066,261, dated Apr. 4, 2013 13 pages.
Official Action for U.S. Appl. No. 13/987,486, dated Dec. 16, 2013 5 pages Restriction Requirement.
Official Action for U.S. Appl. No. 13/987,486, dated Apr. 23, 2014 13 pages.
Official Action for U.S. Appl. No. 13/987,486, dated Oct. 20, 2014 11 pages.
Notice of Allowance for U.S. Appl. No. 13/987,486, dated Jan. 5, 2015 5 pages.
Corrected Notice of Allowance for U.S. Appl. No. 13/987,486, dated Feb. 20, 2015 8 pages.
Official Action for U.S. Appl. No. 14/544,874, dated Dec. 23, 2016 5 pages Restriction Requirement.
Official Action for U.S. Appl. No. 14/544,874, dated Jan. 26, 2017 9 pages.
Official Action for U.S. Appl. No. 14/544,874, dated Jul. 21, 2017 6 pages.
Notice of Allowance for U.S. Appl. No. 14/544,874, dated Sep. 28, 2017 5 pages.
Official Action for U.S. Appl. No. 15/330,223, dated Nov. 15, 2017 6 pages Restriction Requirement.
Official Action for U.S. Appl. No. 15/330,223, dated Feb. 7, 2018 10 pages.
Official Action for U.S. Appl. No. 15/330,223, dated Aug. 7, 2018 10 pages.
Official Action for U.S. Appl. No. 15/330,223, dated Jan. 11, 2019 14 pages.
Official Action for U.S. Appl. No. 14/507,779, dated Apr. 8, 2014 17 pages.
Official Action for U.S. Appl. No. 13/507,779, dated Dec. 1, 2014 17 pages.
Notice of Allowance for U.S. Appl. No. 14/507,779, dated Mar. 6, 2015 8 pages.
Official Action for U.S. Appl. No. 13/986,349, dated Jan. 21, 2015 25 pages.
Official Action for U.S. Appl. No. 13/986,349, dated Aug. 12, 2015 20 pages.
Official Action for U.S. Appl. No. 14/756,594, dated Mar. 29, 2017 13 pages.
Notice of Allowance for U.S. Appl. No. 14/756,594, dated Jun. 5, 2017 8 pages.
Official Action for U.S. Appl. No. 15/731,929, dated Jan. 31, 2019 11 pages.
Official Action for U.S. Appl. No. 14/999,427, dated Oct. 5, 2017 6 pages Restriction Requirement.
Official Action for U.S. Appl. No. 14/999,427, dated Feb. 9, 2018 9 pages.
Notice of Allowance for U.S. Appl. No. 14/999,427, dated Sep. 21, 2018 18 pages.
Official Action for U.S. Appl. No. 15/731,324, dated Feb. 7, 2019 15 pages.
Official Action for U.S. Appl. No. 15/373,979, dated Jan. 29, 2019 12 pages.
International Preliminary Report on Patentability for International (PCT) Patent Application No. PCT/US18/00118, dated Jun. 11, 2020 13 pages.
Notice of Allowance for U.S. Appl. No. 15/932,150, dated May 14, 2020 9 pages.
"Operating Manual: OM WGZC-2 Water-Cooled Scroll Compressor Chillers," McQuay International, 2010, 102 pages.
"R410A // Hermetic Scroll Compressors," Bitzer, 2016, 12 pages.
"Refrigeration Technologies: scroll-compressor chillers," Misto, last modified Jan. 2013, 7 pages.
Notice of Allowance for U.S. Appl. No. 15/330,223, dated Jan. 23, 2020 10 pages.
Official Action for U.S. Appl. No. 15/932,150, dated Nov. 25, 2019 26 pages.
Official Action for U.S. Appl. No. 15/932,150, dated Mar. 5, 2020 19 pages.
Official Action for U.S. Appl. No. 15/732,593, dated Nov. 14, 2019 7 pages Restriction Requirement.
Official Action for U.S. Appl. No. 15/732,593, dated Feb. 19, 2020 13 pages.
"Digital Scroll Compressor Technology," Wikipedia, 2010, 3 pages [retrieved online from: en.wikipedia.org/wiki/Digital_Scroll_Compressor_Technology].
Official Action for U.S. Appl. No. 15/731,929, dated Jun. 4, 2019 10 pages.
Notice of Allowance for U.S. Appl. No. 15/731,929, dated Aug. 14, 2019 9 pages.
Notice of Allowance for U.S. Appl. No. 15/731,324, dated Aug. 2, 2019 11 pages.
Notice of Allowance for U.S. Appl. No. 15/373,979, dated Apr. 26, 2019 9 pages.
International Preliminary Report on Patentability for International (PCT) Patent Application No. PCT/US2018/064427, dated Nov. 19, 2020 8 pages.
Official Action for U.S. Appl. No. 16/291,984, dated Oct. 26, 2020 12 pages.
Official Action for U.S. Appl. No. 16/213,111, dated Sep. 30, 2020 22 pages.
Notice of Allowance for U.S. Appl. No. 15/732,593, dated Aug. 13, 2020 9 pages.

* cited by examiner

LOW COST SCROLL COMPRESSOR OR VACUUM PUMP

CROSS-REFERENCE TO RELATED APPLICATIONS

This application claims the benefit of U.S. Provisional Patent Application Nos. 62/699,529, filed Jul. 17, 2018 and entitled "Low Cost Scroll Compressor or Vacuum Pump," and 62/714,481, filed Aug. 3, 2018 and entitled "Low Cost Scroll Compressor or Vacuum Pump," the entirety of both of which is hereby incorporated by reference herein for all purposes.

GOVERNMENT LICENSE RIGHTS

This invention was made with government support under DE-AR0000648 awarded by the U.S. Department of Energy. The government has certain rights in the invention.

FIELD

The present disclosure relates to scroll devices such as compressors, expanders, or vacuum pumps, and more particularly to non-lubricated scroll devices.

BACKGROUND

Scroll type devices (including compressors, expanders, pumps, and vacuum pumps) may be lubricated or non-lubricated, large or small. Non-lubricated scroll type compressors, and particularly small non-lubricated scroll type compressors, may be sealed by either letting the orbiting scroll float radially so that it contacts the fixed scroll, or by applying an epoxy coating to the scrolls, as described in U.S. Pat. No. 6,511,308 (the entirety of which is incorporated herein by reference). Epoxy sealants are typically cured while the scroll device is running, after which the scroll device is disassembled so that any excess epoxy that may have accumulated therein may be removed.

SUMMARY

A low-cost scroll device according to the present disclosure may comprise a fixed scroll having a plurality of heat transfer fins extending therefrom, with a fan mounted to the scroll device for circulating air past the heat transfer fins.

A low-cost scroll device according to the present disclosure may comprise an orbiting scroll having an involute, a drive pin locating hole, and one or more bearing bores machined into the orbiting scroll from a single side of the orbiting scroll.

A low-cost scroll device according to embodiments of the present disclosure may comprise one or more idler shaft assemblies comprising not more than one bearing in one of the fixed scroll and the orbiting scroll, and a plurality of bearings in the other of the fixed scroll and the orbiting scroll. The not more than one bearing and the plurality of bearings of the one or more idler shaft assemblies may be secured to their respective scrolls by at least two retaining screws.

A low-cost scroll device according to embodiments of the present disclosure may comprise a front counterweight cut from round-bar stock and having an eccentric hole machined therein, for mounting the front counterweight to a motor shaft.

A low-cost scroll device according to embodiments of the present disclosure may comprise fixed and orbiting scrolls each having an involute extending therefore, and each involute may comprise a tip seal groove in a free end thereof. A backup seal and a tip seal may be provided in the tip seal groove, with the backup seal full inserted into the tip seal groove and the tip seal positioned in between the backup seal and an opening of the tip seal groove, the tip seal extending from the tip seal groove.

A low-cost scroll device according to embodiments of the present disclosure may comprise an electric motor for driving an orbiting scroll of the scroll device, and may further comprise a can positioned in between a rotor and a stator of the electric motor so as to prevent leakage of a working fluid of the scroll device through the motor.

A low-cost scroll device according to embodiments of the present disclosure may comprise an epoxy coating applied using a method that requires assembly of the scroll device only once.

A low-cost scroll device according to embodiments of the present disclosure may comprise a motor shaft comprising an integrated, eccentric counter-mass.

The term "scroll device" as used herein refers to scroll compressors, scroll vacuum pumps, and similar mechanical devices. The term "scroll device" as used herein also encompasses scroll expanders, with the understanding that scroll expanders absorb heat rather than generating heat, such that the various aspects and elements described herein for cooling scroll devices other than scroll expanders may be used for heating scroll expanders (e.g., by circulating warm air).

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. When each one of A, B, and C in the above expressions refers to an element, such as X, Y, and Z, or class of elements, such as $X_1$-$X_n$, $Y_1$-$Y_m$, and $Z_1$-$Z_o$, the phrase is intended to refer to a single element selected from X, Y, and Z, a combination of elements selected from the same class (e.g., $X_1$ and $X_2$) as well as a combination of elements selected from two or more classes (e.g., $Y_1$ and $Z_o$).

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

It should be understood that every maximum numerical limitation given throughout this disclosure is deemed to include each and every lower numerical limitation as an alternative, as if such lower numerical limitations were expressly written herein. Every minimum numerical limitation given throughout this disclosure is deemed to include each and every higher numerical limitation as an alternative, as if such higher numerical limitations were expressly written herein. Every numerical range given throughout this disclosure is deemed to include each and every narrower numerical range that falls within such broader numerical range, as if such narrower numerical ranges were all expressly written herein.

The preceding is a simplified summary of the disclosure to provide an understanding of some aspects of the disclosure. This summary is neither an extensive nor exhaustive overview of the disclosure and its various aspects, embodiments, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and configurations of the disclosure are possible utilizing, alone or in combination, one or more of the features set forth above or described in detail below.

BRIEF DESCRIPTION OF THE DRAWINGS

The accompanying drawings are incorporated into and form a part of the specification to illustrate several examples of the present disclosure. The drawings are not to be construed as limiting the disclosure to only the illustrated and described examples.

DETAILED DESCRIPTION

Figure 1:
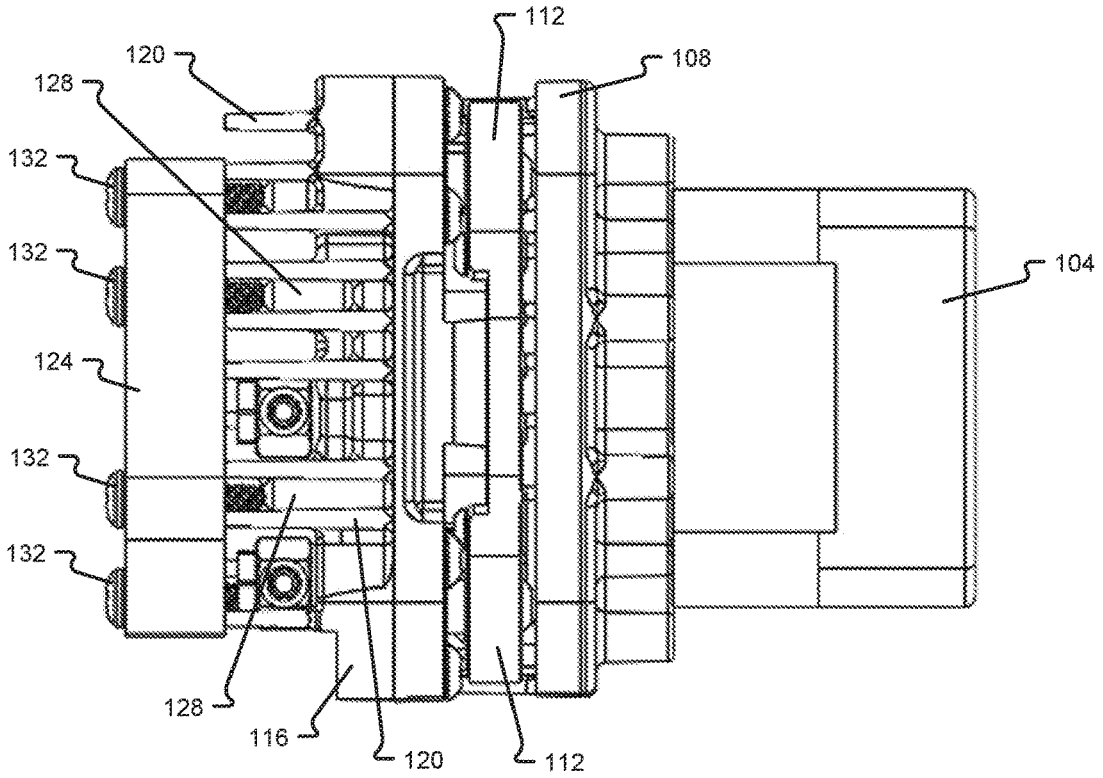
FIG. 1 is a side elevation view of a scroll device according to embodiments of the present disclosure.

Before any embodiments of the disclosure are explained in detail, it is to be understood that the disclosure is not limited in its application to the details of construction and the arrangement of components set forth in the following description or illustrated in the figures. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the present disclosure may use examples to illustrate one or more aspects thereof. Unless explicitly stated otherwise, the use or listing of one or more examples (which may be denoted by "for example," "by way of example," "e.g.," "such as," or similar language) is not intended to and does not limit the scope of the present disclosure.

Small scroll type devices tend to be high cost when compared to other compression devices such as wobble, reciprocating, or diaphragm devices. This high price tends to limit the use of scroll devices to specialized applications or larger sizes.

While the use of epoxy sealant or floating orbiting scrolls helps to overcome the difficulty of sealing small non-lubricated scroll devices, and thus to improve the otherwise typical low performance thereof, these solutions also have drawbacks.

The use of floating orbiting scrolls, for example, requires at least one of the scrolls of the scroll device to be manufactured from a self-lubricating material. Since the material of the fixed scroll and orbiting scroll are not the same, there will be differential thermal expansion as the scroll heats up, resulting in internal leakage problems.

Although epoxy sealants have proven to be effective, the application process is expensive due to the need to run the scroll device while the epoxy cures, and then disassemble the device to remove excess epoxy.

Embodiments of the present disclosure address one or more of the foregoing limitations and drawbacks.

Referring now to the drawings, wherein like numbers refer to like items, a scroll device 100 comprises a motor 104, a housing 108, a plurality of idler shaft assemblies 112, a fixed scroll 116, a plurality of cooling fins 120 extending from the fixed scroll 116, and a cooling fan 124. The motor 104 is secured to the housing 108, and is operably connected to an orbiting scroll contained within the housing 108 and configured to orbit relative to the fixed scroll 116 on the idler shaft assemblies 112. The motor 104 may be powered by electricity, gasoline, hydrogen, natural gas, or any other suitable fuel or energy source. The size of the motor 104 may be selected based on the size of the scroll device 100. The motor 104 may be configured to run at a desired number of rotations per minute, such as 1500 to 3500 RPM, or 1000 to 4000 RPM. Where the motor 104 is electric, the motor 104 may be an AC motor or a DC motor, and may be a brushed motor or a brushless motor. In some embodiments, the motor 104 may be attached directly to the orbiting scroll of the scroll device 100 in a direct drive configuration, while in other embodiments the motor 104 may be operably connected to a gearbox that is, in turn, operably connected to the orbiting scroll.

The cooling fins 120 are provided to facilitate heat transfer away from the fixed scroll 116. The cooling fins 120 may be made of the same material as the fixed scroll 116 (which may be, for example, aluminum or an aluminum alloy), or the cooling fins 120 may be made of a material selected for improved heat transfer characteristics, such as copper. While scroll devices used to compress a working fluid may comprise cooling fins 120, scroll devices used to expand a working fluid may comprise heat transfer fins utilized to warm or heat the scroll device, together with a fan secured to the scroll device for circulating relatively warm air past and around the heat transfer fins.

The cooling fan 124 is mounted on bosses 128 extending from the fixed scroll 116, and is secured thereto in the present embodiment with threaded fasteners 132. In other embodiments, any other suitable fastener type may be used. A suitable fastener type is a fastener type that allows the cooling fan 124 to be secured to the bosses 128 without compromising the operation of the cooling fan 124 for circulating air past the cooling fins 120. The cooling fan 124 provides air circulation past the cooling fins 120 to further improve heat transfer away from the fixed scroll 116. A space is provided between the cooling fan 124 and the bosses 128 to which the cooling fan 124 is mounted so that air can freely circulate through the cooling fan 124 and around the cooling fins 120. In some embodiments, the cooling fan 124 may be driven by a motor other than the motor 104, which separate motor may share a power source with the motor 104, or may be provided with a dedicated or separate power source.

In some embodiments, the cooling fan 124 may be driven by the motor 104. In such embodiments, the cooling fan 124 may be mounted on the opposite side of the scroll device 100, on a shaft extending rearwardly (e.g., away from the housing 108) from the motor 104. Also in such embodiments, the cooling fins may be configured, for example, to extend radially outward relative to an axis of the scroll device 100, and beyond the perimeter of the housing 108, so that air blown by a cooling fan 124 on the same end of the scroll device 100 as the motor 104 can circulate past such cooling fins.

In other embodiments, the cooling fan 124 may be mounted to an extension of an idler shaft of one or more of the idler shaft assemblies 112, which extension(s) may extend past the fixed scroll 116 and past the cooling fins 120 to drive the cooling fan 124.

Figure 2:
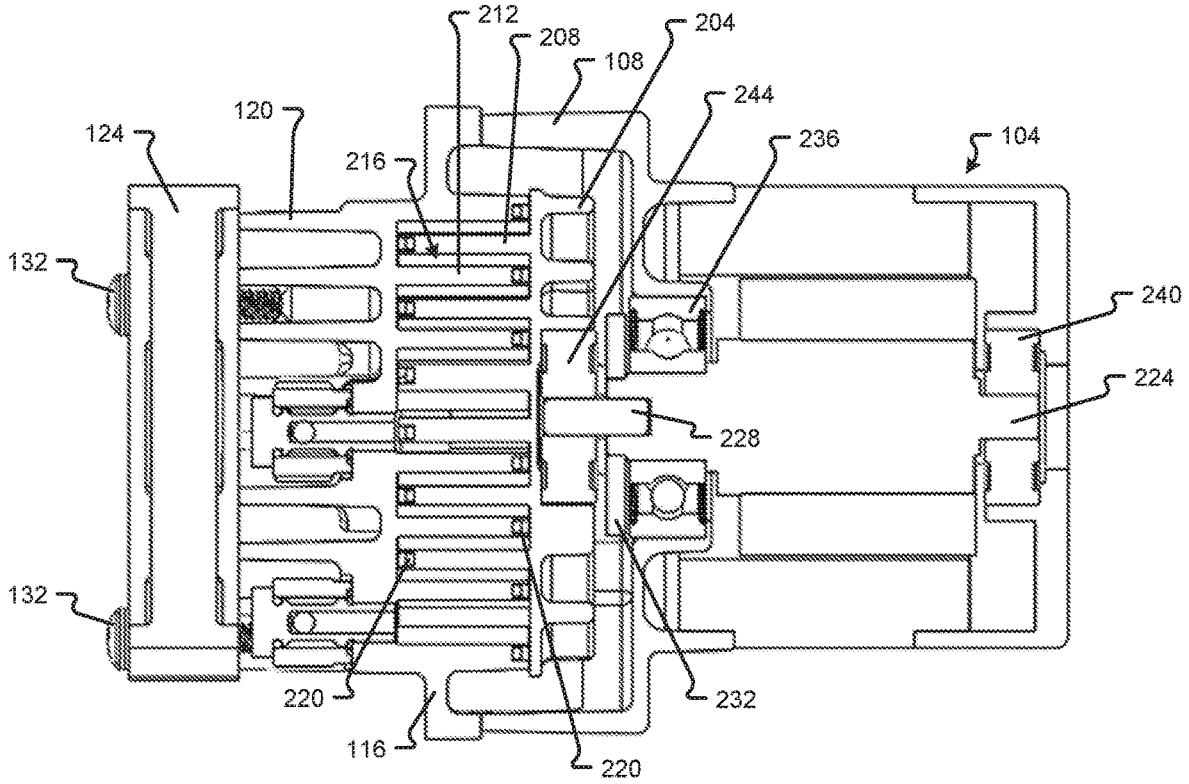
FIG. 2 is a side cross-sectional view of a scroll device according to embodiments of the present disclosure.

FIG. 2 provides a cross-section of the scroll device 100, in which additional details are visible. The orbiting scroll 204 comprises an involute 208, which is configured to cooperate with the involute 212 of the fixed scroll 116 to compress or expand a working fluid of the scroll device 100. More specifically, as the orbiting scroll 204 orbits relative to the fixed scroll 116, the working fluid is compressed or expanded in contracting or expanding pockets 216 formed between the involute 208 of the orbiting scroll 204 and the involute 212 of the fixed scroll 116. Tip seals 220 along the axial-facing surfaces of the free ends of the involutes 208 and 212 prevent leakage of the working fluid from the pockets 216.

The orbiting scroll 204 is operably connected to a motor shaft 224 of the motor 104 via an orbiting scroll drive pin 228. The drive pin 228 is used to transfer torque from the motor shaft 224 to the orbiting scroll 204 (or, in the case of a scroll expander, from the orbiting scroll 204 to a drive shaft). In some embodiments, the orbiting scroll drive pin 228 may be operably connected to a bearing 244 that is secured to the orbiting scroll 204, so that the orbiting scroll drive pin 228 is able to freely rotate relative to the orbiting scroll 204 as it drives the orbiting scroll 204 in an orbiting motion. In other embodiments, the orbiting scroll drive pin 228 may simply act as a shaft within a journal-type bearing provided in the orbiting scroll 204, or the orbiting scroll drive pin 228 may be fixed relative to the orbiting scroll and may rotate relative to the motor shaft 224.

The orbiting scroll 204 is mounted eccentrically relative to the motor shaft 224, so that the motor shaft 224 can drive the orbiting scroll 204 in an orbiting motion. To prevent this eccentricity from causing destructive vibrations when the scroll device 100 is in use, a front counterweight 232 is secured to the motor shaft 224 and provided with an eccentricity that is equal and opposite to the eccentricity of the orbiting scroll 204 (relative to the motor shaft 224). As a result, the forces on the motor shaft 224 are balanced during operation of the motor 104, permitting the scroll device 100 to operate with significantly reduced vibration.

Bearings 236 and 240 support the motor shaft 224, so as to prevent the motor shaft 224 from exerting any undesired forces on the orbiting scroll drive pin 228 and the orbiting scroll 204. Reducing undesirable forces in this manner beneficially improves the lifespan of the orbiting scroll 204.

Figure 3:
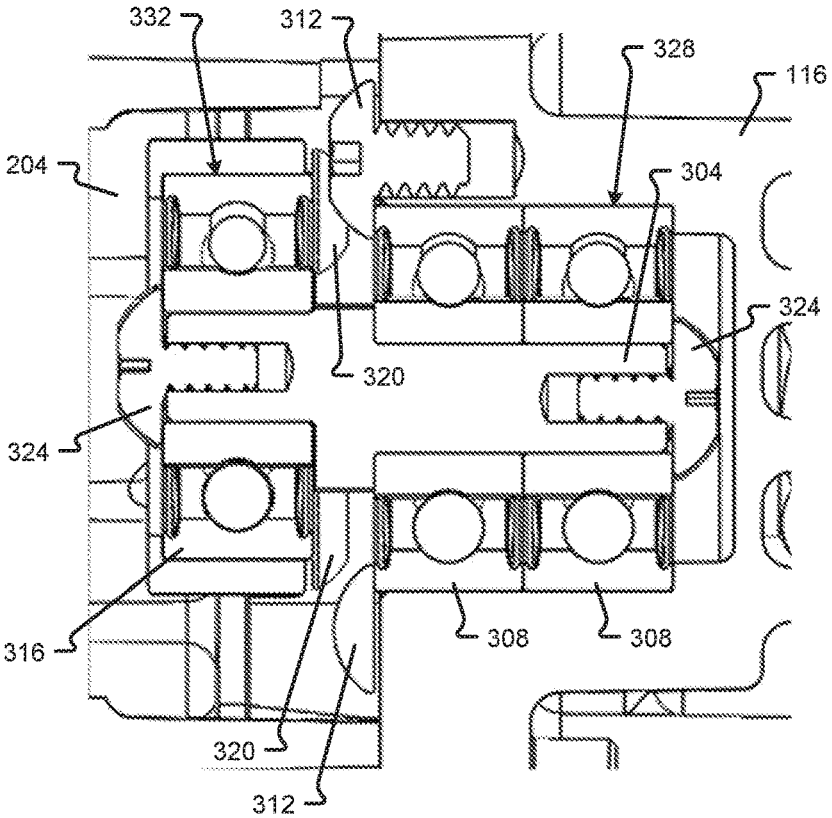
FIG. 3 is a close-up cross-sectional view of an idler shaft assembly according to embodiments of the present disclosure.

FIG. 3 provides a close-up cross-sectional view of an idler shaft assembly 112. There are typically three idler shaft assemblies 112 in a scroll device such as the scroll device 100, which three idler shaft assemblies 112 are typically located approximately 120 degrees from each other between the fixed scroll 116 and the orbiting scroll 204. Two idler shaft assemblies 112 are visible in FIG. 1.

The idler shaft assembly 112 comprises an idler shaft 304, a plurality of bearings 308 fixedly secured to the fixed scroll 116 by at least two retaining screws 312; and a bearing 316 fixedly secured to the orbiting scroll 204 by at least two retaining screws 320. The idler shaft 304 is held in place within the bearings by retaining screws 324.

The bearing bore 328 (referring to the space occupied by the bearings 308 in the fixed scroll 116) and the bearing bore 332 (referring to the space occupied by the bearing 316 in the orbiting scroll 204) may be machined in the fixed scroll 116 and the orbiting scroll 204, respectively, from the same side thereof as the involutes thereof. This allows for very precise positioning of the bearings and for machining of the bearing bores 328 and 332 without a tool change, thus reducing both the machining time and the cost of the fixed scroll 116 and of the orbiting scroll 204.

In the embodiment of FIG. 3, no more than one bearing 316 (per idler shaft assembly 112) is provided in the bearing bore 332 of the orbiting scroll 204 in FIG. 3. In some embodiments, a plurality of bearings 316 (per idler shaft assembly 112) may be provided in the bearing bore 332, rather than just one. However, the use of only one (and no more than one) bearing 316 (per idler shaft assembly 112) in the orbiting scroll 204 beneficially reduces costs, reduces the mass of the orbiting scroll 204, and reduces the friction of the bearing 316. Also in some embodiments, only one bearing 308 (per idler shaft assembly 112) is provided in the bearing bore 328 of the fixed scroll 116.

Thus, in some embodiments, no more than one bearing 316 per idler shaft assembly 112 is provided in the orbiting scroll 204 and a plurality of bearings 308 per idler shaft assembly 112 are provided in the fixed scroll 116. In other embodiments, no more than one bearing 316 per idler shaft assembly 112 is provided in the orbiting scroll 204, and no more than one bearing 308 per idler shaft assembly 112 is provided in the fixed scroll 116. In still other embodiments, a plurality of bearings 316 per idler shaft assembly 112 are provided in the orbiting scroll 204, and no more than one bearing 308 per idler shaft assembly 112 is provided in the fixed scroll 116.

Figure 4:
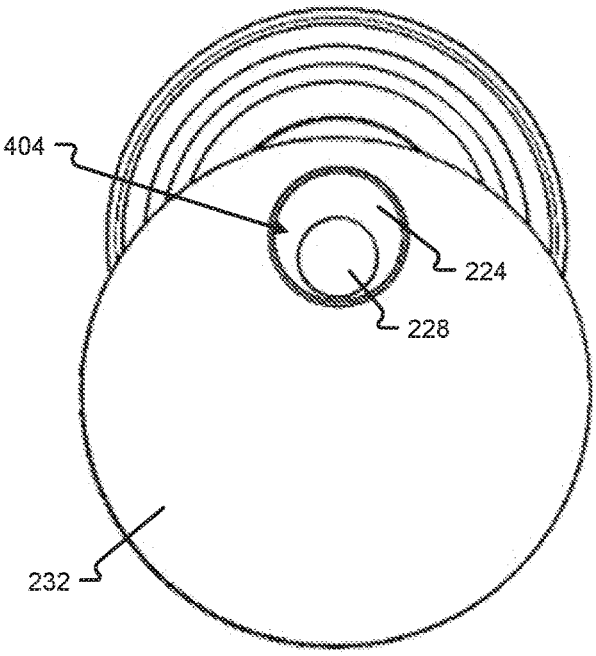
FIG. 4 is a front view of a front counterweight according to embodiments of the present disclosure.

Turning now to FIG. 4, a front view of the front counterweight 232 is shown. Typically, counterweights are made by casting the eccentric mass. The front counterweight 232, however, may be cut from round bar stock to a desired thickness. An eccentric hole may then be drilled into the resulting disk, which hole may be used to mount the front counterweight 232 on the motor shaft 224 (into which the drive pin 228 extends). Fashioning the front counterweight 232 in this way, rather than by casting, greatly reduces the cost of the front counterweight 232.

Figure 5A:
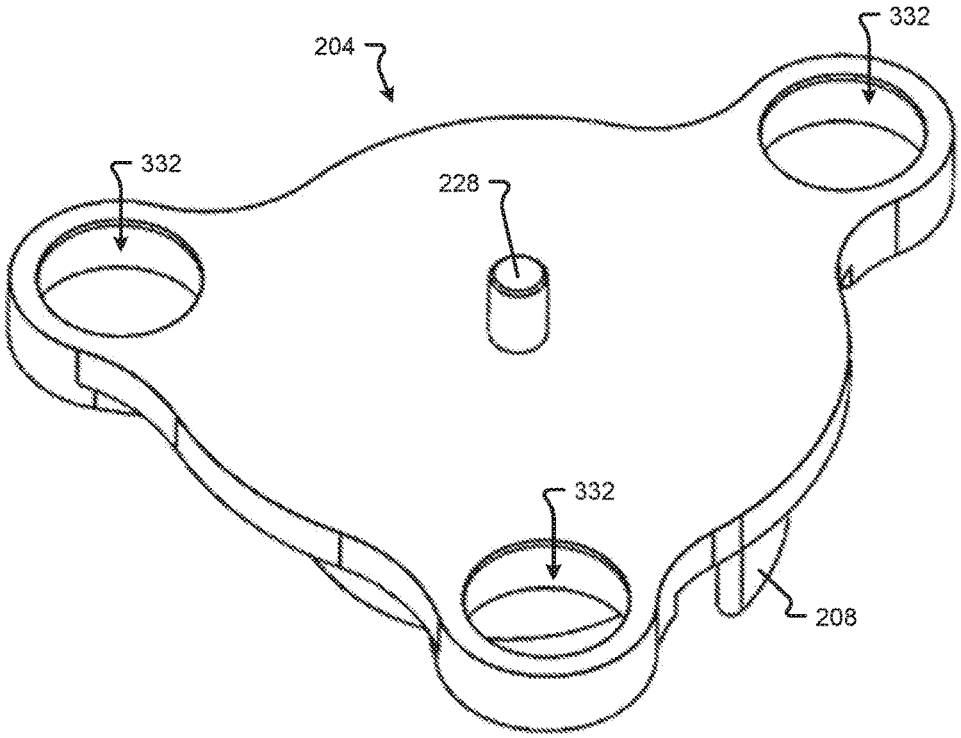
FIG. 5A is a perspective view of an orbiting scroll according to embodiments of the present disclosure.
Figure 5B:
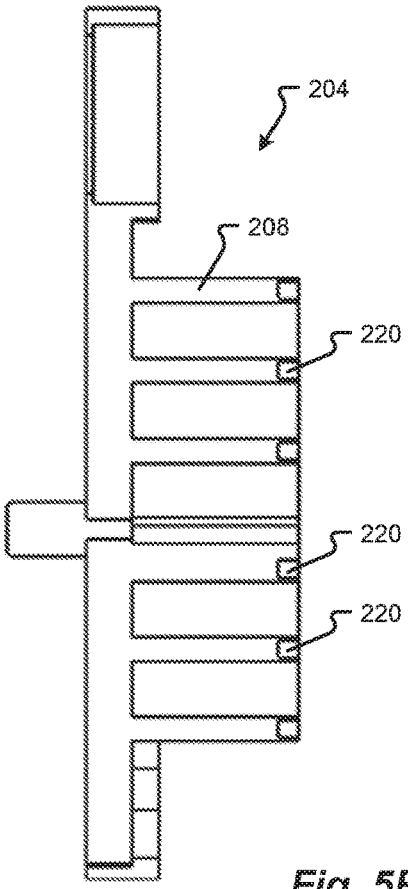
FIG. 5B is a side cross-sectional view of an orbiting scroll according to embodiments of the present disclosure.

FIGS. 5A and 5B show perspective and cross-sectional views of the orbiting scroll 204. Various details may be seen in these views, including the involute 208 of the orbiting scroll 204, the tip seal 220 provided along the axial-facing surface of the free end of the involute 208, and bearing bores 332 in which the bearings 308 of the idler shaft assembles 112 are installed. Also shown in FIGS. 5A-5B is the orbiting scroll drive pin 228. Typically, the drive pin 228 is located in the crankshaft, or machined onto the back side of the orbiting scroll 204. In the embodiment of FIGS. 5A-5B, however, a locating hole for the drive pin 228 is machined into the orbiting scroll 204 from the involute side of the orbiting scroll 204. The locating hole is machined in the same operation as machining the involute of the orbiting scroll 204, thus allowing for precise location of the drive pin 228. The drive pin 228, which may be, for example, a simple dowel pin or a screw machine part, may then be inserted into the locating hole and secured to the orbiting scroll 204. By machining the locating hole for the drive pin 228 in this manner, no machining is required from the back side of the orbiting scroll 204, which greatly reduces machining time for the orbiting scroll 204.

Figure 6:
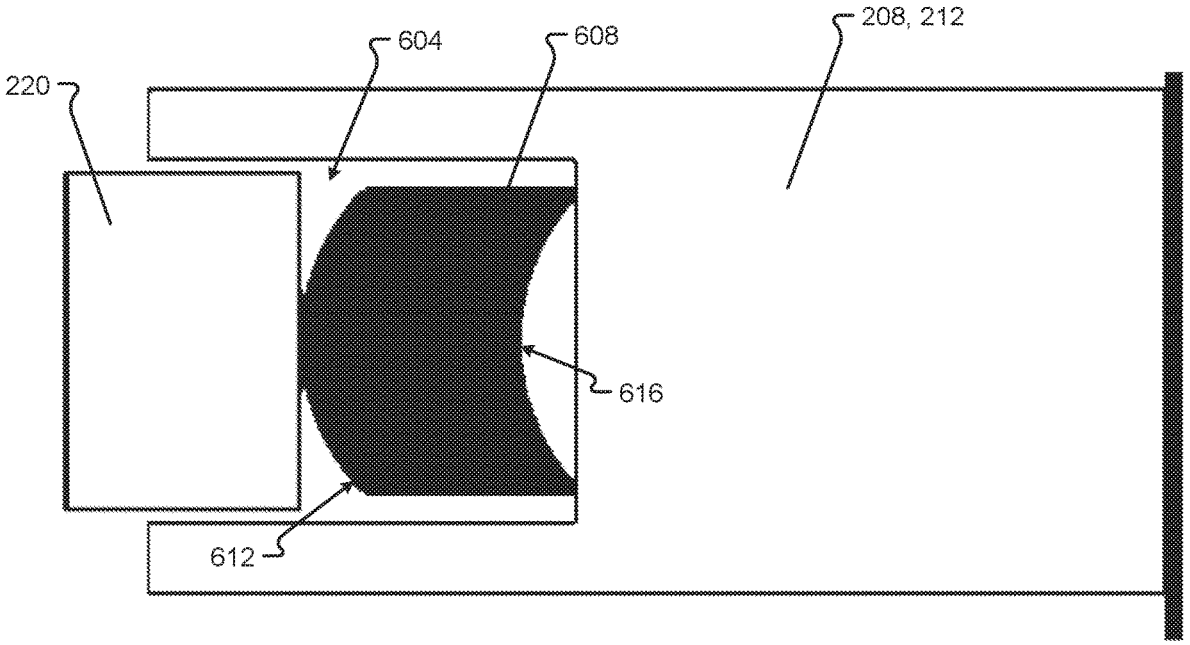
FIG. 6 is a close-up cross-sectional view of a tip seal configuration according to embodiments of the present disclosure.

FIG. 6 shows a cross section of the free end of the involute 208 or 212, as well as of tip seals 220 provided in the free end as shown in FIGS. 2 and 5B. The tip seals 220 are provided within a groove 604 on the axial-facing surface of the free end of the involute 208 of the orbiting scroll 204, and of the involute 212 of the fixed scroll 116. When the tip seal 220 is provided in a groove 604 on the involute 208, the tip seal 220 presses against the fixed scroll 116 (e.g., against a floor of the fixed scroll 116 from which the involute 212 extends) during operation of the scroll device 100. When the tip seal 220 is provided in a groove 604 on the involute 212, the tip seal 220 presses against the orbiting scroll 204 (e.g., against a floor of the orbiting scroll 116 from which the involute 208 extends) during operation of the scroll device 100. The term "opposing scroll" is used for convenience in describing the fixed scroll 116 or orbiting scroll 204 against which the tip seal 220 presses during operation of the scroll device 100.

As shown in FIG. 6, a backup seal 608—which may be made, for example, of a soft elastomeric material such as rubber, and may be, for example, molded or extruded—may be positioned within the groove 604, and the tip seal 220 itself—which may be made, for example, of a self-lubricating material such as polytetrafluorethylene (PTFE)—may be positioned along the open end of the groove 604. The backup seal 608 may be shaped or otherwise configured to compress easily, so as to reduce friction between the tip seal 220 and the opposing scroll, thus reducing wear on the tip seal 220. The backup seal 608 is also sized, shaped or otherwise configured, however, to prevent the tip seal 220 from fitting entirely within the groove 604. The backup seal 608 may comprise, for example, surfaces 612 and 616 that are curved toward the tip seal 220, thus preventing the tip seal 220 from being fully inserted into the groove 604.

A force exerted on the tip seal 220 by the opposing scroll in the direction of the backup seal 608 will cause the tip seal 220 to exert a corresponding force on the backup seal 608, which corresponding force will result (due to the flexible or deformable nature of the backup seal 608) in a flattening of the curved surfaces 612 and 616. This, in turn, will allow the tip seal 220 to be pressed farther into the groove 604. As long as the backup seal 608 is in a compressed position, the backup seal 608 will exert a force on the tip seal 220 in the direction of the opening of the groove 604 and the opposing scroll. Thus, the backup seal 608, when compressed, biases the tip seal 220 against the opposing scroll, thus helping to maintain contact, and a sealed interface, between the tip seal 220 and the opposing scroll.

Figure 7A:
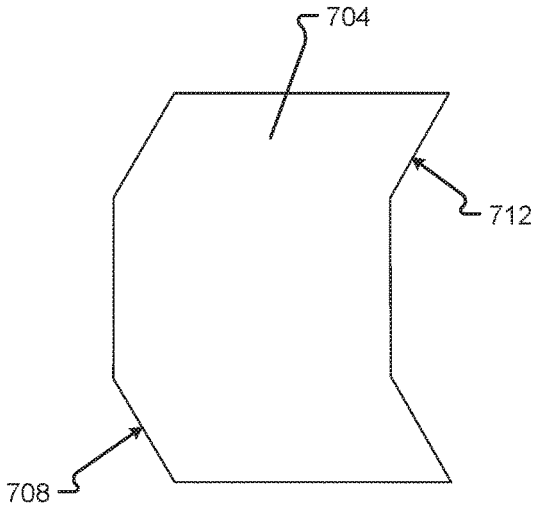
FIG. 7A is a cross-sectional side view of a backup seal configuration according to embodiments of the present disclosure.
Figure 7B:
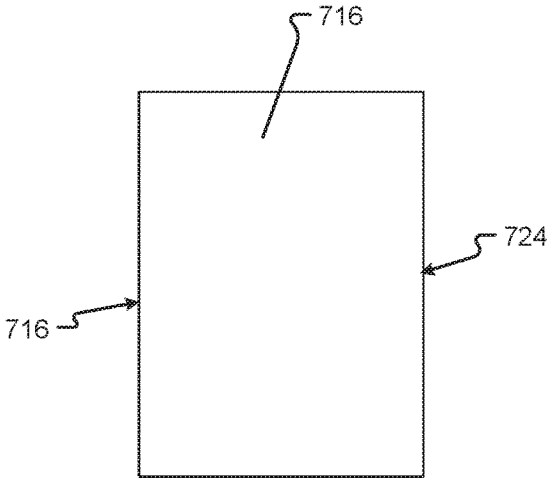
FIG. 7B is a cross-sectional side view of another backup seal configuration according to embodiments of the present disclosure.

FIGS. 7A-7B illustrate two alternate backup seal configurations. The backup seal 704 comprises surfaces 708 and 712 that are angled rather than curved, but the principle of operation is the same as described above with respect to the backup seal 608. The backup seal 716, on the other hand, is a simple block, with flat surfaces 720 and 724. Although the backup seal 716 does not have any surfaces that can flatten in response to a force exerted by the tip seal 220 (because the surfaces of the backup seal 716 are already flat), such a force will cause the backup seal 716 to compress in the direction of the force. Thus, the distance between the surfaces 720 and 724 will decrease, while the backup seal 716 will expand in a plane approximately perpendicular to the direction of the force. As with the backup seals 608 and 704, the elastomeric nature of the backup seal 716 will cause the backup seal 716 to exert a force on the tip seal 220 in the direction of the opening of the groove 604 and the opposing scroll, so as to bias the tip seal 220 against the opposing scroll and maintain a sealed interface therewith. Other backup seal configurations not illustrated in the present figures may also be used in accordance with embodiments of the present disclosure.

Figure 8:
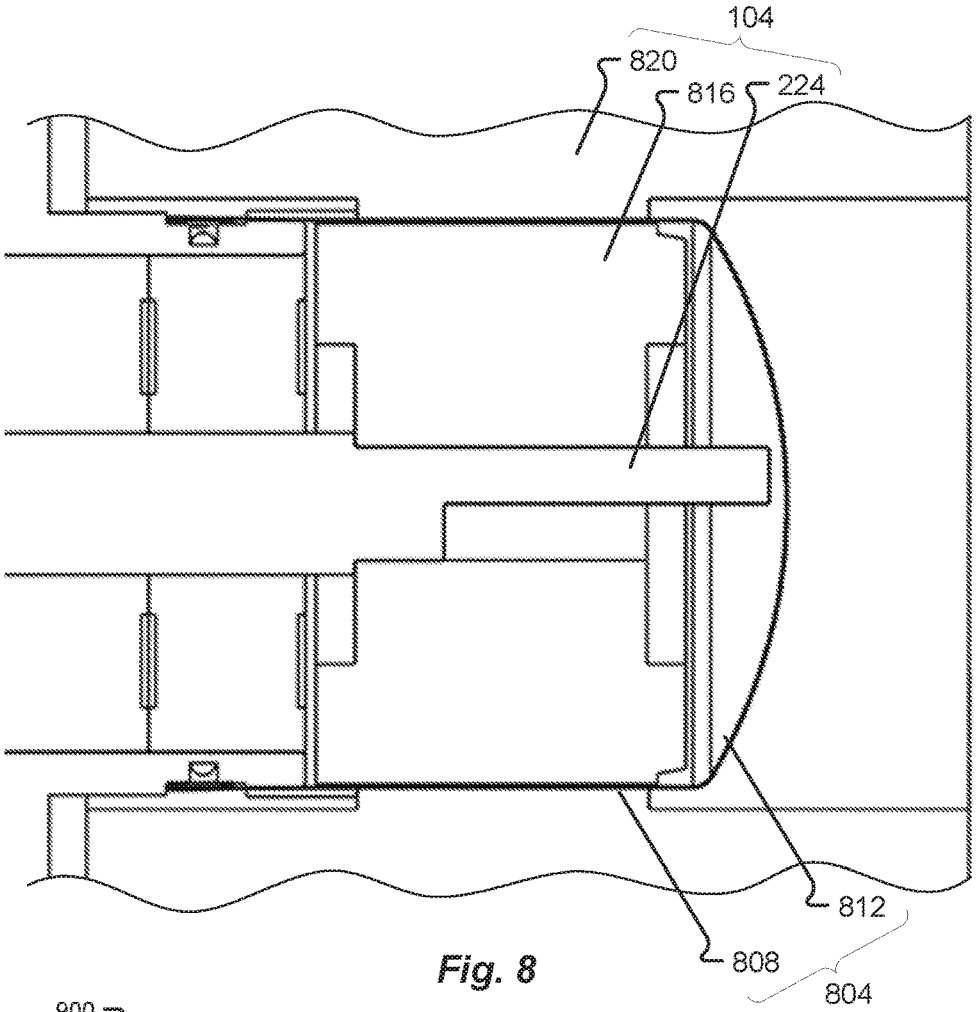
FIG. 8 is a cross-sectional view of a canned motor according to embodiments of the present disclosure.

With reference now to FIG. 8, the intended use of a scroll device 100 (such as for compression or expansion of gasses other than air) may require that the scroll device 100 be semi-hermetic. In such embodiments, a can or canister 804, comprising a cylindrical body 808 and a cap 812, may be placed over the rotor 816 of an electric motor 104, such that the rotor 816 is sealed off (or at least substantially sealed off) from the stator 820 of the motor 104. The can 804 can be made using a simple molding method, or using any other known or suitable method. The motor shaft 224, which is operably connected to the rotor 816, is also positioned within the can 804. The can 804 thus seals the working fluid within the scroll device 100 so that it cannot leak to the atmosphere (or so that only a negligible amount of the working fluid is able to leak to the atmosphere). A semi-hermetic scroll device 100 also requires a sealed housing 108 to ensure that the working fluid remains completely contained, or substantially completely contained, within the scroll device 100.

Figure 9:
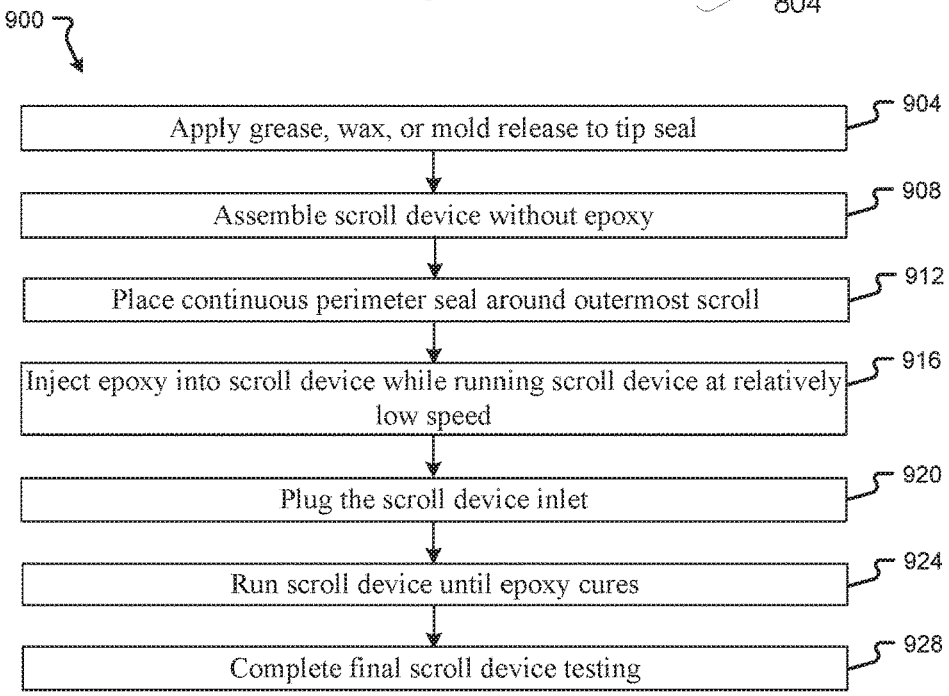
FIG. 9 is a flow chart of a method of applying epoxy to a scroll device according to embodiments of the present disclosure.

FIG. 9 is a flowchart of a method 900 of applying epoxy to a scroll device such as the scroll device 100 that represents a significant improvement over known epoxy application processes.

The method 900 comprises applying grease, wax, or mold release to the tip seal 220 of the scroll device 100 to which epoxy will be applied (step 904). The grease, wax, or mold release may be coated onto the tip seal 220 directly (so as to prevent epoxy from bonding to the tip seal 220), or may be placed in the tip seal groove 604 after the backup seal 608 has been installed in the tip seal groove 604. The grease, wax, or mold release may protect the tip seal 220 and/or the backup seal 608 during, for example, the steps 916 and 924. In some embodiments, once epoxy injected into the scroll device 100 has cured, heat may be used to melt the grease, wax, or mold release, which may then be poured or otherwise removed from the scroll device 100.

The method 900 also comprises assembling the scroll device 100 (step 908). This is done before any epoxy is applied to the scroll device 100. Moreover, the scroll device 100 will not be disassembled prior to final testing and shipping. As a result, the scroll device 100 is fully assembled so as to include all components thereof.

The method 900 also comprises placing a continuous perimeter seal around the outermost scroll (step 912). The continuous perimeter seal allows the scroll device 100 to draw a vacuum during curing of the epoxy, which assists in pulling the epoxy from the inlet port of the scroll device 100 to the discharge port of the scroll device 100 for a complete coating of the involutes 208 and 212. In some embodiments, the fixed scroll 116 comprises an involute 212 that surrounds the involute 208 of the orbiting scroll 204. In such embodiments, the continuous perimeter scroll may be placed around the outer perimeter of the involute 212 of the fixed scroll 216, at the end of the involute 212 closest to the orbiting scroll 204. The continuous perimeter seal thus prevents the working fluid of the scroll device 100 from leaking out of the scroll device 100 to the surrounding environment. In other embodiments, the orbiting scroll 204 comprises an involute 208 that surrounds the involute 212 of the fixed scroll 116. In such embodiments, the continuous perimeter scroll may be placed around the outer perimeter of the involute 208 of the orbiting scroll 204, at the end of the involute 208 closest to the fixed scroll 116. In these embodiments also, the continuous perimeter seal prevents the working fluid of the scroll device 100 from leaking out of the scroll device 100 to the surrounding environment. In some embodiments, the continuous perimeter seal works in the same manner or in a similar manner to the tip seal 220 described elsewhere herein.

The method 900 also comprises injecting epoxy into the scroll device 100 while running the scroll device 100 at a relatively slow speed (step 916). For example, the scroll device 100 may be run at 1500 to 4000 RPM, or at 2000 to 3300 RPM, or at 2500 to 3000 RPM. In some embodiments, the scroll device 100 may be run at 1500 RPM or less, or at 1000 RPM or less, or at 500 RPM or less. As the suction volume of the scroll device increases, the speed of the scroll device may be further reduced. Additionally, the epoxy is injected into the working fluid inlet of the scroll device 100 where the scroll device 100 is a scroll compressor, or into the working fluid outlet of the scroll device 100 where the scroll device 100 is a scroll expander. Only a desired amount of epoxy is injected into the scroll device 100, which desired amount corresponds to the amount of epoxy needed to coat the surfaces of the involutes 208 and 212 within the scroll device 100.

The method 900 also comprises plugging the opening through which the desired amount of epoxy was injected into the scroll device 100 (step 920). The plugged opening is the working fluid inlet of the scroll device 100 where the scroll device 100 is a scroll compressor, or the working fluid outlet of the scroll device 100 where the scroll device 100 is a scroll expander. Plugging the opening beneficially enables the scroll device 100 to draw a vacuum.

The method 900 also comprises running the scroll device 100 continuously until the epoxy cures (step 924). The epoxy may cure in as little as ten minutes, or in as much as four to eight hours or more. The curing time may depend on factors such as, for example, the interior temperature of the scroll device 100 (and whether heat is being applied to the scroll device 100 to speed the curing process, or the epoxy is being allowed to cure at room temperature), the amount of epoxy injected into the scroll device 100, the thickness of the epoxy coating within the scroll device 100, the type of epoxy used, and/or the ratio of epoxy resin to epoxy hardener in the inserted epoxy.

The method 900 also comprises completing final testing of the scroll device 100 (step 928). The final testing may include any desired or needed testing to ensure that the scroll device 100 operates as desired and/or intended. Prior to completing the final testing, the plug of step 920, which was used to plug the opening of the scroll device 100 through which the desired amount of epoxy was injected in step 916, may be removed. The testing may include, for example, running the scroll device 100 at a variety of speeds, including at the lowest operating speed thereof and/or at the highest operating speed thereof; listening for evidence of or otherwise detecting any foreign matter within the scroll device 100; testing the operating characteristics of the scroll device 100 (including, for example, the maximum pressure, the maximum flow, the maximum power consumption, and/or the maximum power output thereof); and testing the scroll device 100 for acceptable levels of vibration.

Figure 10:
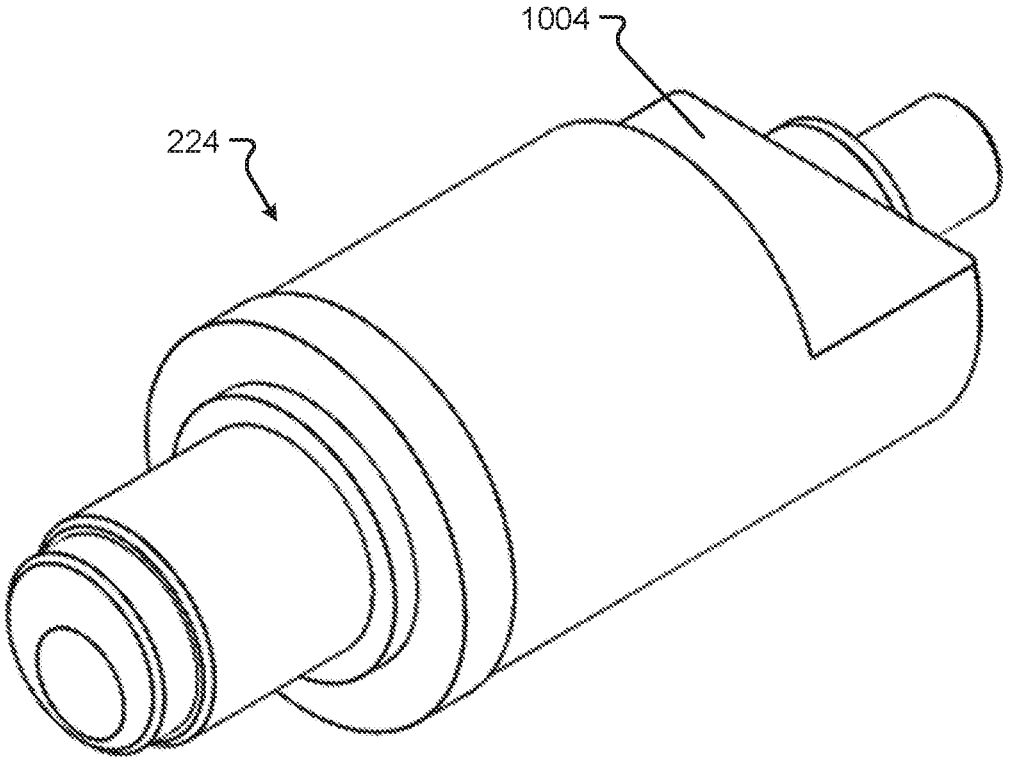
FIG. 10 is a perspective view of a motor shaft with an integrated counter-mass according to embodiments of the present disclosure.

With reference now to FIG. 10, the motor shaft 224 may comprise an integrated, eccentric counter-mass 1004. Typical scroll designs comprise a rear counter-mass separate from the motor shaft to help balance the forces and moments exerted on and within the scroll device assembly. However, by providing a counter-mass 1004 that is integrated into the drive shaft 224, the rear counter-mass may be eliminated, thus reducing the complexity of the scroll device 100 as well as machining costs for the scroll device 100.

The size and position of the counter-mass 1004 integrated into the motor shaft 224 may be selected based on the size and direction of the forces and moments exerted on and within the scroll device 100 as well as the position of the source of those forces and moments (e.g., an orbiting mass such as the orbiting scroll 204). Ideally, the counter-mass 1004 is sized and positioned to balance out (together with a front counter-mass) the forces and moments in question by generating equal and opposite forces and moments during operation of the scroll device 100.

Figure 11:
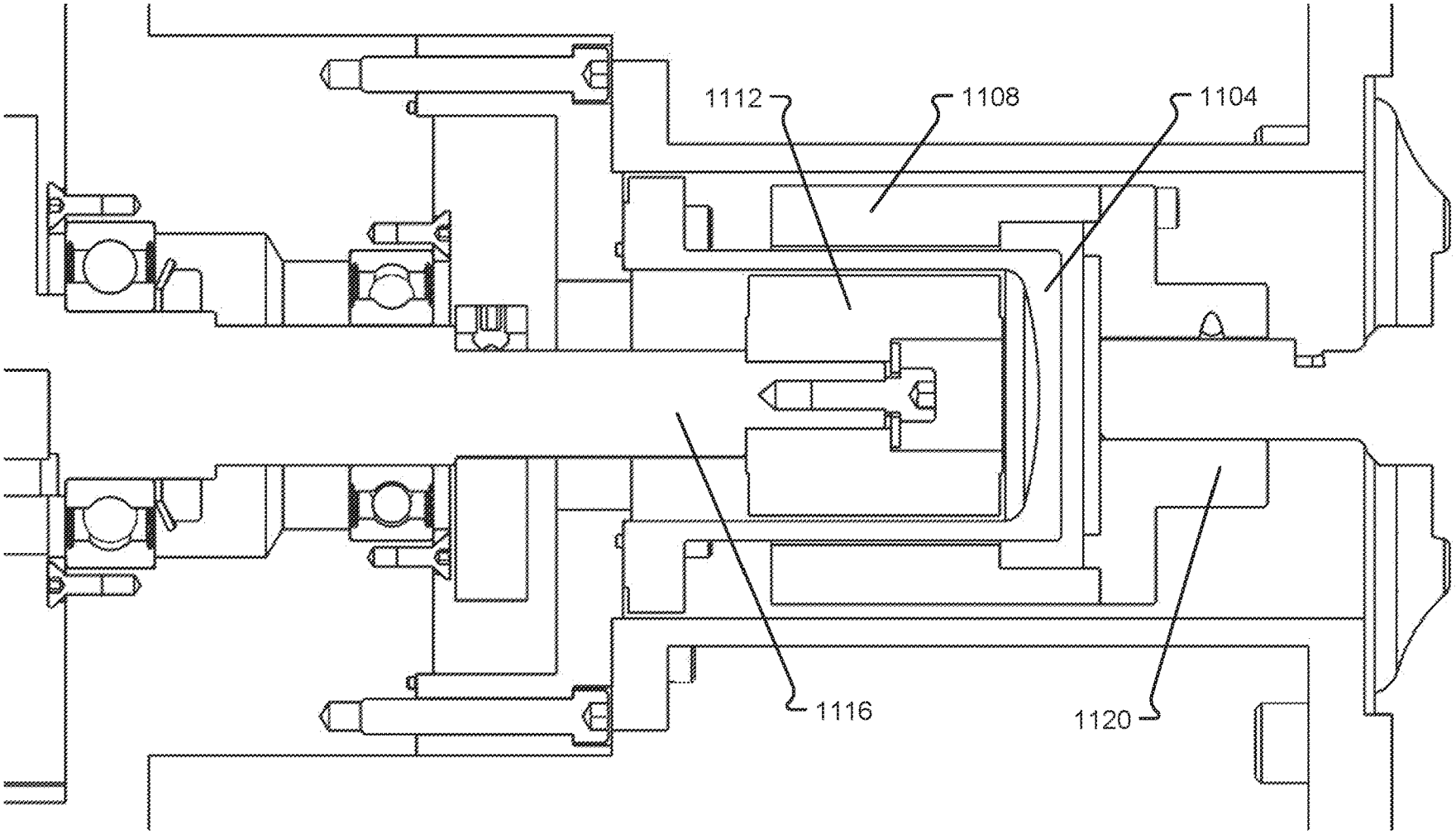
FIG. 11 is a cross-sectional view of a scroll device according to embodiments of the present disclosure.

FIG. 11 shows a cross-section of a scroll device that comprises a can or canister 1104. The can or canister 1104 provides an alternative to (although it may be used in addition to) the can 804 described above for obtaining a semi-hermetic scroll device. Whereas the can 804 is placed between the motor stator 820 and the motor rotor 816, the can 1104 is placed between two magnets 1108 and 1112 used to transmit torque from the driving device shaft or rotor 1120 to the compressor or expander shaft 1116. More specifically, the separate canister 1104 is positioned such that one magnet 1108 is outside the canister 1104 and the other magnet 1112 is inside the canister 1104, so that the magnetic coupling between the two magnets 1108, 1112 transmits torque across the canister 1104. The magnet 1108 is part of or is operably secured to (whether directly or via one or more intermediate components) a motor rotor 1120 (which may be the same as or similar to the motor rotor 816), while the magnet 1112 is part of or secured to the compressor or expander shaft 1116 of the scroll device (which may be, for example, a scroll device such as the scroll device 100). Where the scroll device is a scroll device 100 and is being used as a compressor or vacuum pump, the torque generated by the motor 104 is transmitted across the canister 1104 to the orbiting scroll 204 via the magnetic coupling between the magnets 1108 and 1112. Where the scroll device 100 is being used as an expander, the torque is generated as gas expands between the involutes of the fixed scroll 116 and the orbiting scroll 204 and causes the orbiting scroll 204 to orbit relative to the fixed scroll 116, which torque is transmitted from the orbiting scroll 204 across the canister 1104 to a generator or other energy converter via the magnetic coupling between the magnets 1108 and 1112.

Like the can 804, the separate canister 1104 may be made from a simple molding method. Moreover, the separate canister may be made from any material that does not prevent interoperability of the torque-transferring magnets and that is impervious to the working fluid of the scroll device 100.

The magnets 1104 and 1112 used to transmit torque from the driving device shaft or rotor 1120 to the compressor or expander shaft 1116 across the canister 1104 may be permanent magnets, such as alnico (aluminum, nickel, and cobalt) magnets; ceramic or ferrite magnets; neodymium magnets; and/or samarium-cobalt magnets. In some embodiments, one or both of the torque-transmitting magnets 1104 and 1108 may be electromagnets that are energized, for example, only when the motor 104 is operating.

Embodiments of the present disclosure comprise a low-cost scroll compressor, scroll vacuum pump, and/or scroll expander.

Embodiments of the present disclosure include a scroll device with a single idler shaft bearing on one scroll and two idler shaft bearings on the other scroll.

Embodiments of the present disclosure include a scroll device comprising a scroll having an involute and at least one idler shaft bearing bore, wherein the at least one idler shaft bearing bore is machined from the same side of scroll as the involute for precision and to eliminate a tool change, reducing machining time and cost.

Embodiments of the present disclosure include a scroll device comprising idler shaft bearings installed in bearing bores, wherein retaining screws are used to prevent the idler shaft bearings from moving in the bearing bores.

Embodiments of the present disclosure include a scroll device with a counterweight cut from round bar stock and having an eccentric hole therein for mounting the counterweight to a shaft, such as the motor shaft.

Embodiments of the present disclosure include a scroll device with a center drive pin on the orbiting scroll, the pin secured within a hole machined from the involute side of the scroll for precision and to eliminate any need to machine the back side of the scroll.

Embodiments of the present disclosure include an epoxy curing process that requires a scroll device to be assembled only once.

Embodiments of the present disclosure include a scroll device wherein grease, mold release or wax is used to prevent epoxy from bonding to the tip seal.

Embodiments of the present disclosure include a scroll device wherein the back-up seal has a cross section with at least two curved surfaces, or with at least two angled surfaces, or that is rectangular, or that is square.

Embodiments of the present disclosure include a semi hermetic scroll device wherein a can is placed between the rotor and stator of the motor for preventing leakage of a working fluid from the scroll device through the motor.

Embodiments of the present disclosure include a scroll device wherein the drive shaft and rear counter-mass are integrated into a single piece.

Embodiments of the present disclosure include a scroll device wherein a magnetic coupling is used to transmit torque from a driving device (e.g., a motor) to a shaft that drives the orbiting scroll of the scroll device.

A number of variations and modifications of the disclosure can be used. It would be possible to provide for some features of the disclosure without providing others.

Embodiments of the present disclosure include a scroll device comprising: a fixed scroll comprising a first side opposite a second side, the first side comprising a first involute and a second side comprising a plurality of cooling fins; an orbiting scroll comprising a second involute, the orbiting scroll mounted to the fixed scroll via a mechanical coupling and configured to orbit relative to the fixed scroll on the mechanical coupling; a motor operably connected to the orbiting scroll; and a cooling fan mounted to the second side of the fixed scroll.

Aspects of the foregoing scroll device include: wherein the mechanical coupling comprises at least one idler shaft assembly, the idler shaft assembly comprising a single bearing provided in a first bearing bore of one of the fixed scroll and the orbiting scroll, a plurality of bearings provided in a second bearing bore of another of the fixed scroll and the orbiting scroll, and an idler shaft supported by the first bearing and the plurality of bearings; wherein the first bearing bore is positioned in the orbiting scroll, and the second bearing bore is positioned in the fixed scroll; at least two retaining screws positioned to secure the single bearing in the first bearing bore, and at least two additional retaining screws positioned to secure the plurality of bearings in the second bearing bore; wherein the first bearing bore is machined in the orbiting scroll from the same side of the orbiting scroll as the second involute; wherein the first involute comprises a groove, the scroll device further comprising: a backup seal positioned within the groove; and a tip seal extending from the groove; wherein the motor is operably connected to the orbiting scroll via a motor shaft, and the scroll device further comprises a front counterweight secured to the motor shaft; wherein the front counterweight is cut from round bar stock and comprises an eccentric hole through which the motor shaft extends; wherein the motor shaft comprises an integrated, eccentric counter-mass; wherein the motor is operably connected to the orbiting scroll via a drive pin, and the drive pin is positioned in a hole machined in the orbiting scroll from the same side as the second involute; wherein the motor is operably connected to the orbiting scroll via a magnetic coupling; and a canister positioned between the motor and the orbiting scroll, the canister configured to prevent leakage of a working fluid through the motor, the magnetic coupling configured to transmit torque from the motor to the orbiting scroll through the canister.

Embodiments of the present disclosure also include a semi-hermetic scroll device comprising: a fixed scroll comprising a first involute; an orbiting scroll comprising a second involute, the orbiting scroll mounted to the fixed scroll via a mechanical coupling and configured to orbit relative to the fixed scroll on the mechanical coupling; a motor operably connected to the orbiting scroll, the motor comprising a stator and a rotor; and a can comprising a cylindrical body and a cap, the cylindrical body positioned between the stator and the rotor and the cap covering one end of the rotor, the can configured to prevent leakage of a working fluid through the motor.

Aspects of the foregoing semi-hermetic scroll device include: wherein the second involute comprises: a groove along a free end of the second involute, the groove having a floor, two opposing walls, and an open end, a tip seal seated within the groove, and, a backup seal positioned within the groove in between the tip seal and the floor; wherein the backup seal comprises a curved surface adjacent the floor and a curved surface adjacent the tip seal; wherein the backup seal comprises an angled surface adjacent the floor and an angled surface adjacent the tip seal; wherein the backup seal comprises a flat surface adjacent the floor and a flat surface adjacent the tip seal; grease, wax, or mold release adjacent the tip seal; and wherein the mechanical coupling comprises three idler shaft assemblies, each idler shaft assembly comprising: no more than one bearing secured within a bearing bore of the orbiting scroll by at least two retaining screws, a plurality of bearings secured within a bearing bore of the fixed scroll by at least two additional retaining screws, and an eccentric shaft secured to the plurality of bearings and the one bearing.

Embodiments of the present disclosure further include a scroll device comprising: an orbiting scroll comprising an involute, a drive pin hole, and a plurality of first bearing bores all machined from a single side of the orbiting scroll; a fixed scroll comprising an involute and a plurality of second bearing bores; a plurality of idler shaft assemblies, each idler shaft assembly comprising: at least one first bearing secured within one of the plurality of first bearing bores by at least two retaining screws; at least one second bearing secured within one of the plurality of second bearing bores by at least two additional retaining screws; and an eccentric idler shaft secured to the at least one first bearing and the at least one second bearing; a drive pin secured within the drive pin hole; and a motor operably connected to the drive pin and configured to cause the orbiting scroll to orbit relative to the fixed scroll.

Ranges have been discussed and used within the forgoing description. One skilled in the art would understand that any sub-range within the stated range would be suitable, as would any number or value within the broad range, without deviating from the invention. Additionally, where the meaning of the term "about" as used herein would not otherwise be apparent to one of ordinary skill in the art, the term "about" should be interpreted as meaning within plus or minus five percent of the stated value.

Throughout the present disclosure, various embodiments have been disclosed. Components described in connection with one embodiment are the same as or similar to like-numbered components described in connection with another embodiment.

Although the present disclosure describes components and functions implemented in the aspects, embodiments, and/or configurations with reference to particular standards and protocols, the aspects, embodiments, and/or configurations are not limited to such standards and protocols. Other similar standards and protocols not mentioned herein are in existence and are considered to be included in the present disclosure. Moreover, the standards and protocols mentioned herein and other similar standards and protocols not mentioned herein are periodically superseded by faster or more effective equivalents having essentially the same functions. Such replacement standards and protocols having the same functions are considered equivalents included in the present disclosure.

The present disclosure, in various aspects, embodiments, and/or configurations, includes components, methods, processes, systems and/or apparatus substantially as depicted and described herein, including various aspects, embodiments, configurations embodiments, subcombinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and/or reducing cost of implementation.

The foregoing discussion has been presented for purposes of illustration and description. The foregoing is not intended to limit the disclosure to the form or forms disclosed herein. In the foregoing Detailed Description, for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

Any of the steps, functions, and operations discussed herein can be performed continuously and automatically.

What is claimed is:

1. A scroll device comprising:

a fixed scroll comprising a first side opposite a second side, the first side comprising a first involute and the second side comprising a plurality of cooling fins;

an orbiting scroll comprising a second involute, the orbiting scroll mounted to the fixed scroll via a mechanical coupling and configured to orbit relative to the fixed scroll on the mechanical coupling;

at least two retaining screws positioned to secure a single bearing of the mechanical coupling in a first bearing bore of one of the fixed scroll and the orbiting scroll, and at least two additional retaining screws positioned to secure a plurality of bearings of the mechanical coupling in a second bearing bore of another of the fixed scroll and the orbiting scroll;

a motor operably connected to the orbiting scroll; and a cooling fan mounted to bosses extending from the second side of the fixed scroll with a plurality of fasteners.

2. The scroll device of claim 1, wherein the mechanical coupling comprises at least one idler shaft assembly, the idler shaft assembly comprising the single bearing the plurality of bearings, and an idler shaft supported by the single bearing and the plurality of bearings.

3. The scroll device of claim 2, wherein the first bearing bore is positioned in the orbiting scroll, and the second bearing bore is positioned in the fixed scroll.

4. The scroll device of claim 3, wherein the first bearing bore is machined in the orbiting scroll from the same side of the orbiting scroll as the second involute.

5. The scroll device of claim 1, wherein the first involute comprises a groove, the scroll device further comprising:

a backup seal positioned within the groove; and a tip seal extending from the groove.

6. The scroll device of claim 1, wherein the motor is operably connected to the orbiting scroll via a motor shaft, and the scroll device further comprises a front counterweight secured to the motor shaft.

7. The scroll device of claim 6, wherein the front counterweight is cut from round bar stock such that the front counterweight has a circular outer perimeter and comprises an eccentric hole through which the motor shaft extends.

8. The scroll device of claim 6, wherein the motor shaft comprises an integrated, eccentric counter-mass.

9. The scroll device of claim 1, wherein the motor is operably connected to the orbiting scroll via a drive pin, and the drive pin is positioned in a hole machined in the orbiting scroll from the same side as the second involute, wherein a first end of the drive pin extends into a recess in a motor shaft of the motor and a second end of the drive pin is offset from the first involute of the fixed scroll by a predetermined distance.

10. The scroll device of claim 1, wherein the motor is operably connected to the orbiting scroll via a magnetic coupling.

11. The scroll device of claim 10, further comprising a canister positioned between the motor and the orbiting scroll, the canister configured to prevent leakage of a working fluid through the motor, the magnetic coupling configured to transmit torque from the motor to the orbiting scroll through the canister.

12. A semi-hermetic scroll device comprising:

a fixed scroll comprising a first involute;

an orbiting scroll comprising a second involute, the orbiting scroll mounted to the fixed scroll via a mechanical coupling and configured to orbit relative to the fixed scroll on the mechanical coupling, wherein the mechanical coupling comprises three idler shaft assemblies, each idler shaft assembly comprising:

no more than one bearing secured within a bearing bore of the orbiting scroll by at least two retaining screws;

a plurality of bearings secured within a bearing bore of the fixed scroll by at least two additional retaining screws; and an eccentric shaft secured to the plurality of bearings and the one bearing;

a motor operably connected to the orbiting scroll, the motor comprising a stator and a rotor; and a can comprising a cylindrical body and a cap, the cylindrical body positioned between the stator and the rotor and the cap covering one end of the rotor, the can configured to prevent leakage of a working fluid through the motor.

13. The scroll device of claim 12, wherein the second involute comprises:

a groove along a free end of the second involute, the groove having a floor, two opposing walls, and an open end;

a tip seal seated within the groove, and;

a backup seal positioned within the groove in between the tip seal and the floor.

14. The scroll device of claim 13, wherein the backup seal comprises a concave curved surface adjacent the floor and a concave curved surface adjacent the tip seal.

15. The scroll device of claim 13, wherein the backup seal comprises an angled surface adjacent the floor and an angled surface adjacent the tip seal.

16. The scroll device of claim 13, wherein the backup seal comprises a flat surface adjacent the floor and a flat surface adjacent the tip seal.

17. The scroll device of claim 13, further comprising grease, wax, or mold release adjacent the tip seal.

18. A scroll device comprising:

an orbiting scroll comprising an involute, a drive pin hole, and a plurality of first bearing bores all machined from a single side of the orbiting scroll;

a fixed scroll comprising an involute and a plurality of second bearing bores;

a plurality of idler shaft assemblies, each idler shaft assembly comprising:

at least one first bearing secured within one of the plurality of first bearing bores by at least two retaining screws;

at least one second bearing secured within one of the plurality of second bearing bores by at least two additional retaining screws; and an eccentric idler shaft secured to the at least one first bearing and the at least one second bearing;

a drive pin secured within the drive pin hole; and a motor operably connected to the drive pin and configured to cause the orbiting scroll to orbit relative to the fixed scroll.

* * * * *